US008978165B2

(12) United States Patent
Franco et al.

(10) Patent No.: US 8,978,165 B2
(45) Date of Patent: Mar. 17, 2015

(54) HELMET PROTECTIVE SKIN

(76) Inventors: Jorge L. Franco, Santa Maria, CA (US); Averill Henry, Santa Maria, CA (US)

( * ) Notice: Subject to any disclaimer, the term of this patent is extended or adjusted under 35 U.S.C. 154(b) by 432 days.

(21) Appl. No.: 13/065,536

(22) Filed: Mar. 23, 2011

(65) Prior Publication Data

US 2012/0240310 A1 Sep. 27, 2012

Related U.S. Application Data

(60) Provisional application No. 61/340,823, filed on Mar. 22, 2010.

(51) Int. Cl.
*A42B 3/04* (2006.01)
*A42B 3/00* (2006.01)

(52) U.S. Cl.
CPC ..... *A42B 3/003* (2013.01)
USPC ..... 2/209.13; 2/244

(58) Field of Classification Search
USPC ..... 2/209.13, 422, 209.14, 244, 175.6
See application file for complete search history.

(56) References Cited

U.S. PATENT DOCUMENTS 3,155,981 A * 11/1964 McKissick et al. ..... 2/422
3,245,087 A * 4/1966 Marchello ..... 2/422
4,993,082 A * 2/1991 Gentes et al. ..... 2/410
5,349,702 A * 9/1994 Runckel ..... 2/68
D362,085 S * 9/1995 Hause et al. ..... D29/122
6,061,836 A * 5/2000 Peters ..... 2/175.6
6,101,636 A * 8/2000 Williams ..... 2/410
D435,698 S * 12/2000 Gill ..... D29/102
6,202,219 B1 * 3/2001 Cheever ..... 2/195.2
6,237,162 B1 * 5/2001 Gill ..... 2/422
6,256,799 B1 * 7/2001 McGlasson et al. ..... 2/422
6,654,967 B2 * 12/2003 Haar ..... 2/209.13
6,848,122 B1 * 2/2005 Meeds ..... 2/422
7,114,198 B1 * 10/2006 Hsieh et al. ..... 2/422
D533,312 S * 12/2006 Bouchez ..... D29/102
7,802,321 B2 * 9/2010 Boyd ..... 2/422
7,854,025 B2 * 12/2010 Spinelli ..... 2/425
D666,777 S * 9/2012 Dhillon ..... D29/122
2001/0004773 A1 * 6/2001 Moore ..... 2/425
2002/0157173 A1 * 10/2002 Murasko et al. ..... 2/425
2006/0117463 A1 * 6/2006 Spinelli ..... 2/244
2007/0107112 A1 * 5/2007 Boyd ..... 2/410
2008/0222782 A1 * 9/2008 Stokes ..... 2/422
2011/0088149 A1 * 4/2011 Spinelli ..... 2/422
2011/0296593 A1 * 12/2011 Dhillon ..... 2/410
2012/0236544 A1 * 9/2012 Dorman ..... 362/106

* cited by examiner

*Primary Examiner* — Andrew W Collins
(74) *Attorney, Agent, or Firm* — Raymond Y. Chan; David and Raymond Patent Firm

(57) ABSTRACT

A replaceable helmet protective skin, which is adapted for covering an outer surface of a helmet, includes a skin body configured to attach and detach while in use fittingly cover the outer surface of the helmet as if part of the outer surface thereof in an edge-to-edge manner, wherein the skin body is formed a receiving cavity therewithin for fittingly receiving the helmet to cover the outer surface thereof. At least one adjustable fastener is preferably provided along an elongated opening of the skin body, so that the size of the receiving cavity of the skin body is able to be increased via opening the adjustable fastener for conveniently attaching and detaching when covering or removing the replaceable helmet protective skin. The adjustable fastener is able to be adjustably closed for securely fitting the skin body on the outer surface of the helmet.

5 Claims, 3 Drawing Sheets

HELMET PROTECTIVE SKIN

CROSS REFERENCE OF RELATED APPLICATION

This is a non-provisional application of a provisional application, application No. 61/340,823, filed Mar. 22, 2010.

BACKGROUND OF THE PRESENT INVENTION

1. Field of Invention

The present invention relates to a helmet protective skin, and more particular to a replaceable protective skin cover for the helmet, which is able to enhance the aesthetic outer appearance of the helmet and provide further protection thereof.

2. Description of Related Arts

The helmet is invented mainly for the protection of the head portion of human beings from injuries as one of the personal protective equipments. During the intense or high risk activities, such as combat, riding motorcycles or bicycles, snowboarding, and a variety of other sports, the helmet is normally required for minimizing the injuries to the head and face. The helmet commonly has an inner layer, an absorption layer, and an outer ridged layer made of plastic, resin, or metal etc. for maximizing the protection thereof.

In order to provide a variety of styles of the helmet, varieties of colors, design patterns or personalized graphics are printed on the outer surface layer of helmets. Therefore, a helmet wearer has a diversity of choices to select from when purchasing a helmet according to their personal taste or activities. For instance, the helmet wearer may want to purchase a helmet having the same color scheme as his or her racing car.

For personal or team identification purposes, the name and/or team logo may be printed on the helmet. Commercial corporations, groups, or companies may also print their company name or product name on the helmet, so that when the wearer, such as a person that is a fan of a well known athlete, can wear a helmet with the athletes number, team logo, or image. Helmet protective skins can also provide a canvas for such advertisement features.

Moreover, minor incidental scratches on the outer surface of the helmet without damaging the actual structure of the helmet may occur during-intense activities or by merely transporting the helmet. Personalized graphics previously described can be applied to the outer shell of helmets by airbrushing, which can cost from $250.00 to $350.00 USD. Helmet protective skins can be used to prevent unsightly scratches or can be used in lieu of airbrushing by placing the personalized graphic on the helmet protective skin. For meticulous persons, helmet protective skins will cover up unsightly scratches and dings on the helmets outer surface that may not amount to structural damage, requiring the wearer to buy another expensive helmet in order to have a newly looking helmet.

The helmet wearers may also have more than one helmet for the same purpose or activity for a variety of appearances and styles to satisfy their aesthetic feeling. In order to completely change the appearance of the helmet, the wearer would have to purchase another helmet with different graphics thereon. Thus, the wearer will need more storage space and thus spend a lot more money for their personal protective equipment.

Although there are some stickers provided to decorate and personalize the helmet, the stickers having a flat attaching surface is hard to perfectly and securely attach them on the helmet. The stickers being attached on the helmet while being worn on the head of wearer in the outdoor environment tend to peel off easily from the peripheral edge thereof. After stickers detach from the helmet, the sticker can not be reused and often leave unsightly adhesive and grime on the outer surface of the helmet.

SUMMARY OF THE PRESENT INVENTION

An object of the present invention is to provide a replaceable helmet protective skin for a helmet, which is configured to detachably and fittingly cover an outer surface of a helmet to form as part of the outer layer thereof, so as to protect the helmet. In other words, the replaceable helmet protective skin forms an outfit of the helmet.

Another object of the present invention is to provide a replaceable helmet protective skin for a helmet, which is a sport tech helmet protective skin configured to be attached and detached as a cover over the outer surface of a helmet to form an innovative and technologically advanced helmet.

Another object of the present invention is to provide a replaceable helmet protective skin, which has a shape and size approximately matching the outer surface of the helmet, so that the helmet protective skin is able to cover the outer surface of the helmet in an edge-to-edge manner.

Another object of the present invention is to provide a replaceable helmet protective skin, which has a variety of patterns, colors, and styles for providing a variety of selections, so that a wearer of the helmet is able to selectively and simply replace the helmet protective skins with a different graphic thereon, such as a logo or name of a sport team, for the purposes of identification, advertisement, or enhancing the aesthetic feelings of the wearer.

Another object of the present invention is to provide a replaceable helmet protective skin, wherein the adjustable fastener enables the helmet protective skin to be easily opened in order to be detached and re-attached to the helmet.

Another object of the present invention is to provide a replaceable helmet protective skin, wherein the replaceable helmet protective skin preferably made of elastic material is able to perfectly and elastically conform to the size and shape of the helmet.

Another object of the present invention is to provide a replaceable helmet protective skin, which is able to be easily removed for washing or replacing it with another bearing different graphics according to the preference of the wearer.

Another object of the present invention is to provide a replaceable helmet protective skin, wherein the replaceable helmet protective skin is made of a reusable material, such as rubber, fabric, Nylon, Lycra, Plastic, and/or combinations thereof.

Another object of the present invention is to provide a replaceable helmet protective skin, wherein the replaceable helmet protective skin is made of breathable material while having a waterproof function, such as the fabric material of neoprene, and breathable over air-vents to allow air flow between an inner cavity of the helmet and the outer environment while protecting the helmet.

Another object of the present invention is to provide a replaceable helmet protective skin, wherein the helmet protective skin offers waterproof protection, resistance to ultraviolet light, and grease and/or oil resistant.

Another object of the present invention is to provide a replaceable helmet protective skin, wherein an insulation layer integrally formed with the helmet protective skin is further provided to prevent excessive heat, so as to protect the helmet and aid in comfort.

Another object of the present invention is to provide a replaceable helmet protective skin, wherein a reflective material is provided at crucial areas thereof to maximize night visibility while in use, so as to enhance the safety of the wearer.

Another object of the present invention is to provide a replaceable helmet protective skin, wherein the helmet protective skin is able to incorporate with most of the existing types of helmets. For instances, motor-sports; and other sports requiring helmets such as football or hockey players, jet skiing, kayaking, snowmobiles, rock climbing and bicycling or helmets used in military combat or by Law Enforcement Officers.

Accordingly, in order to accomplish the above objectives, the present invention provides a replaceable helmet protective skin for covering an outer surface of a helmet.

The replaceable helmet skin comprises a skin body configured to detachably and fittingly attach to the outer surface of the helmet as if part of the outer surface thereof in an edge-to-edge manner, wherein the skin body has a receiving cavity therewithin for fittingly receiving the helmet, so as to cover the outer surface thereof.

At least one adjustable fastener is preferably provided along an elongated opening of the skin body, so that the size of the receiving cavity of the skin body is able to be increased via opening the adjustable fastener for conveniently attaching and detaching the replaceable helmet protective skin. The adjustable fastener is then closed for a secure fit over the outer surface of the helmet.

These and other objectives, features, and advantages of the present invention will become apparent from the following detailed description, the accompanying drawings, and the appended claims.

DETAILED DESCRIPTION OF THE PREFERRED EMBODIMENT

Figure 1:
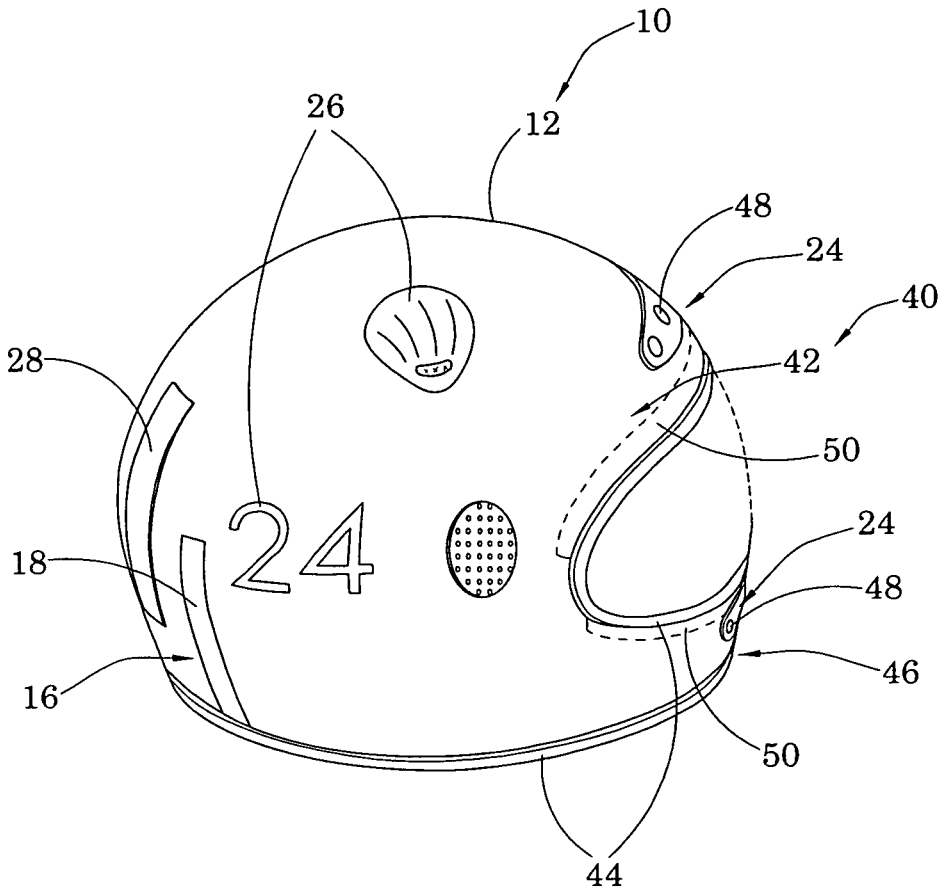
FIG. 1 is a perspective view of a helmet protective skin according to a preferred embodiment of the present invention, illustrating the helmet protective skin incorporating with a helmet.
Figure 2:
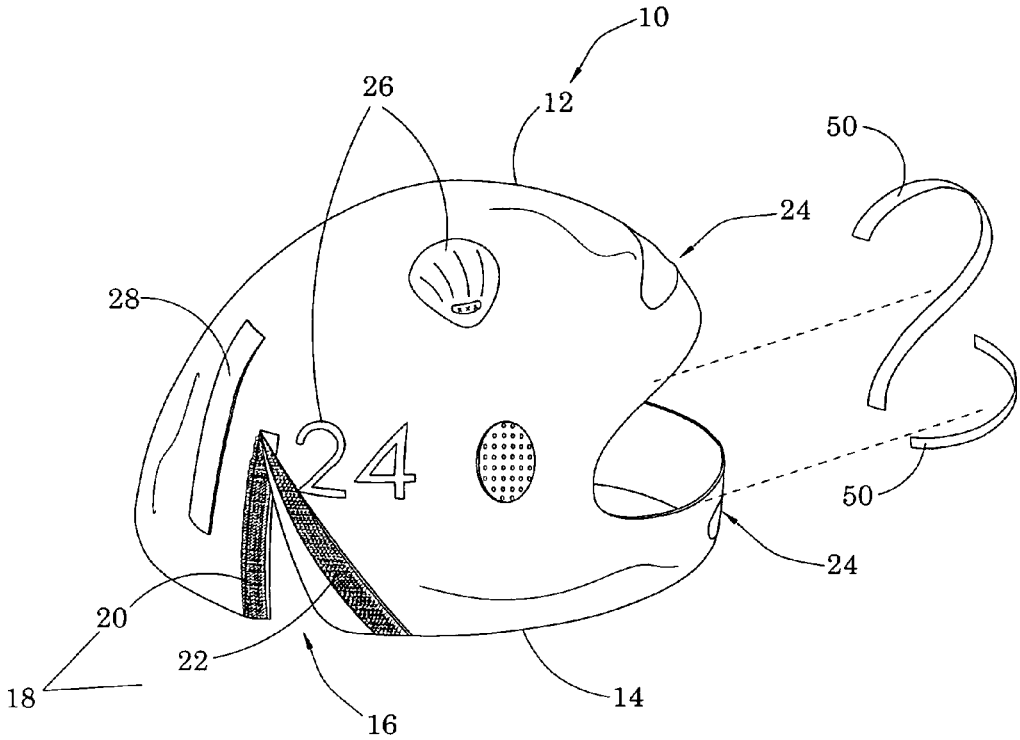
FIG. 2 is a 3-dimensional exploded view of the helmet protective skin according to the above preferred embodiment.
Figure 2:
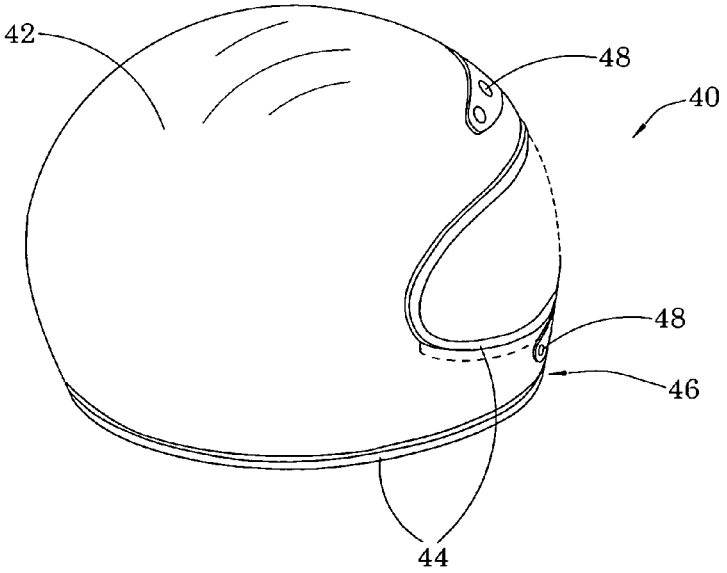

Referring to FIGS. 1 and 2 of the drawings, a helmet protective skin according to a preferred embodiment of the present invention is illustrated, wherein the replaceable helmet protective skin 10 comprises a skin body 12, which is configured for detachably and fittingly covering an outer surface 42 of a helmet 40 for being worn on a head of a wearer.

Accordingly, the skin body 12 has a shape and size approximately matching the shape and size of the outer surface 42 of the helmet 40 for attaching the skin body 12 thereon in an edge-to-edge manner, so that the skin body 12 of the replaceable skin 10 is able to detachably and replaceably cover as part of the outer surface 42 of the helmet 40.

More specifically, the skin body 12 having the similar shape and size of the helmet 40 is detachably covering the outer surface 42 thereof to align a peripheral edge of the skin body 12 with the peripheral edge of the helmet 40. As shown in FIG. 1, the peripheral edge of the skin body 12 is preferably aligning with one or more finishing rim 44 provided at each of peripheral edges of the helmet 40 and to form a gap 46 between the helmet and the finishing rims 44, so that the peripheral edge of the skin body 12 is able to be received within the gap 46 as if integrally formed at the outer surface 42 of the helmet 40. Preferably, the peripheral edge of the skin body 12 can be an elastic edge to alignedly fit along the peripheral edge of the helmet 40 by means of elastic force to retain the skin body 12 in position.

A frontal lobe ring attachment (not shown in the Figures) of the finishing rim 44 may be further provided at an underside of the upper front facial opening of a full-face type helmet. One or more quarter ring attachments may be further provided at a portion of the underside of facial opening of a quarter type helmet thereat, so that the helmet protective skin is able to be attached and detached from the outer surface of the helmet via the quarter ring attachment and/or the frontal lobe ring attachment.

Alternatively, a plurality of elastic clips, preferably having a U-shape, are spacedly provided along the peripheral edge of the skin body 12 to detachably affix along the peripheral edge of the helmet 40 so as to retain the skin body 12 in position.

Preferably, a fastener 50 is provided along the inner side of the peripheral edge of the skin body 12 to affix along the peripheral edge of the helmet 40 to retain the peripheral edge of the skin body 12 aligning with the finishing rim 44 of the helmet 40. Accordingly, the fastener 50 is preferably a double-sided tape defining an outer adhering side affixing to the inner side of the skin body 12 and an inner adhering side affixing to the outer side of the helmet 40. Preferably, two fasteners 50 are detachably affixed to the finishing rim 44 of the helmet 40 at the upper and lower sides of the front facial opening thereof respectively.

As best shown in FIG. 2, the skin body 12 has a receiving cavity 14 therewithin for receiving the helmet 40 to detachably cover the outer surface 42 thereof via the skin body 12, so as to fittingly coupling the skin body 12 thereon. At least one elongated opening 16 is further provided at the skin body 12, preferably extended at a rear portion thereof to extend to the peripheral edge of the skin body 12, so as to form an edge notch thereat, so that the opening 16 is able to be opened to increase a space of the receiving cavity 14 of the skin body 12, so as to detachably and conveniently couple the skin cover 12 with the outer surface 42 of the helmet 40.

Still referring to FIG. 2 of the drawings, in order to securely and adjustably covering the helmet protective skin 10 on the outer surface 42 of the helmet 40, at least one adjustable fastener 18 is preferably provided at the elongated opening 16 to adjust the size of the opening 16 and to open and close the opening 16, so as to securely and fittingly attach the skin body 12 at the helmet 40. In other words, the adjustable fastener 18 preferably has at least a first connecting element 20 and a second connecting element 22 for detachable fastening with the first connecting element 20, wherein the first and second connecting elements 20, 22 of the adjustable fastener 18 are provided along two elongated edges of the elongated opening 16 for detachable fastening with each other to securely close the elongated opening 16, in such a manner that after the helmet 40 is being received by the receiving cavity 14 of the skin body 12 to incorporate the skin body 12 with the helmet 40, the elongated opening 16 is able to be closed via the adjustable fastener 18 to securely and fittingly couple the skin body 12 with the helmet 40.

As will be readily appreciated by one skilled in the art, the adjustable fastener 18 can be any types of fastener for securely closing the elongated opening 16 to fittingly and detachable coupling the skin body 12 at the outer surface 42 of the helmet 40. For examples, the adjustable fastener 18 may be a hook and loop type fastener of the first and second connecting elements 20, 22 provided at each of the elongated edges of the opening 16, so that the adjustable fastener 18 is able to be closed and opened for increasing the receiving cavity space to attach or detach the skin body 12 covering the outer surface 42 of the helmet 40 and closed for securely and fittingly coupling the skin body 12 therewith. The adjustable fastener 18 may also be magnetic elements, hooks and slots, glue, grommets, snaps, buttons, zippers, or the likes.

It is worth to mention that the adjustable fastener 18 may be able to be fastened to selectively adjust a diameter or space of the receiving cavity 14 of the skin body 12. For instance, the first connecting element 20 may be wider than the second connecting element 22, such that second connecting element 22 is able to selectively and partially fasten with the first connecting element 20 in order to adjust the size of the receiving cavity 14 of the skin body 12 to better fit the helmet protective skin 10 to the helmet 40. Another first or second fastener 20, 22 may further provided at a position adjacent to the elongated opening 16 to spacedly form next the original first or second fastener 20, 22 along the elongated opening 16, in such a manner that the adjustable fastener 18 can also adjustably fasten the elongated opening 16 to fittingly secure the replaceable helmet protective skin 10 at the outer surface 42 of the helmet 40. Therefore, the skin body 12 being able to replaceable and detachably covering the helmet 40 is able for incorporating with most of the helmets in the existing market.

Figure 3:
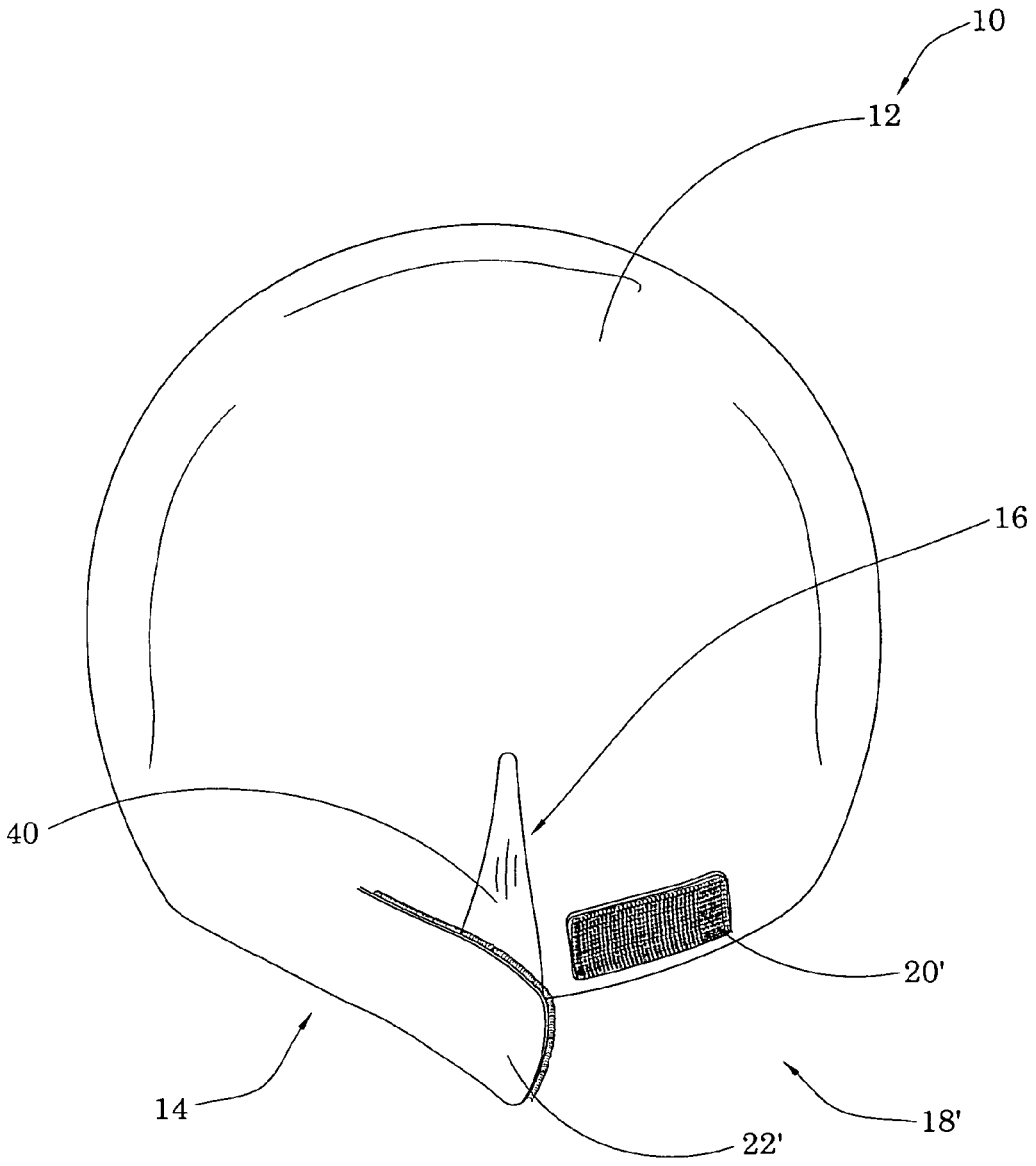
FIG. 3 illustrates an alternative mode of the adjustable fastener of the helmet protective skin according to the above preferred embodiment.

FIG. 3 illustrates an alternative mode of the adjustable fastener 18', wherein the adjustable fastener 18' comprises a first connecting element 20' and a second connecting element 22' for detachable fastening with the first connecting element 20'. The first connecting element 20' is provided at the outer side of the skin body 12 along the bottom peripheral edge of the skin body 12 and is located at one side edge of the elongated opening 16. The second connecting element 22' is outwardly extended from the opposed side edge of the elongated opening 16 to form an elongated strap to detachably fasten with the first connecting element 20'. Therefore, after the helmet 40 is received within the receiving cavity 14 of the skin body 12, the second connecting element 22' is adapted to be pulled to tightly align the peripheral edge of the skin body 12 with the finishing rim 44 of the helmet 40 and to fasten with the first connecting element 20' so as to close the elongated opening 16 for securely and fittingly coupling the skin body 12 with the helmet 40.

As shown in FIGS. 1 and 2, the helmet 40 may further has one or more air vents 48 extended through a shell body of the helmet 40 to enhance the air circulation between an inner cavity for receiving the head of the wearer and outer environment of the shell body of the helmet 40. The skin body 12 further has one or more through holes 24 provided at a position aligning with the air vents 48 of the helmet 40, so that the through hole 24 is able to maximize the air flow of the helmet 40, so as to enhance the comfortableness of the wearer. It is appreciated that the through holes 24 may also formed at a position aligning with one or more add-on devices protruded out of the outer surface 42 of the helmet 40, such as Chatterbox and Audiovox communication device, for accommodating add-on devices thereof.

Accordingly, the skin body 12 having a diversity of colors may further has one or more graphic portions 26 thereat, wherein the graphic portions 26 may be printed or integrally formed with the material of the skin body 12, such as stitching or sewing. The graphic portions 26 may be any design patterns, personal name or number, team logos, or commercial products, so that the replaceable helmet protective skin 10 is able to provide the functionalities of identification, fashion, and/or advertisement.

As mentioned above, the skin body 12 of the replaceable helmet protective skin 10 is preferably made of an elastic material, so that the replaceable helmet protective skin 10 is able to better fit to the outer surface 42 of the helmet 40 to give a more decent aesthetic feeling for the wearer. The skin body 12 may also made of a reusable material and/or washable materials, such as such as rubber, fabric, Nylon, Lycra, Plastic, leather, vinyl, neoprene, and/or the combinations thereof. Therefore, the skin body 12 not only can be easily removed for replacing with different patterns or graphics thereof according to the preference of the wearer, but also can be removed for washing and reusing the helmet protective skin 10.

It is worth to mention that, with the replaceable helmet protective skin 10, the wearer is able to keep changing the appearances of his/her helmet without purchasing numerous expensive helmets 40, so as to minimize the store space for helmet equipment while satisfying the fashionable purpose of the helmet.

It is appreciated that the replaceable helmet protective skin 10 also provide the protection of the outer surface 42 of the helmet, so that while wearing or transporting the helmet 40, the skin body 12 is able to prevent the scratches formed thereat. Therefore, it may not be necessary for the wearer using an extra helmet bag to protect the helmet while carrying the helmet from one place to another, so as to eliminate the need for additional helmet accessories.

Accordingly, with the replaceable helmet protective skin 10 attachable and detachable covering 40, the wearer of the helmet 40 is able to have different styles of helmets 40, change the identification or commercial signs thereon, and wash the replaceable helmet protective skin 10 to keep the helmet 40 looking new without changing the undamaged structure of the helmet 40 itself, so as to protect the helmet 40. Therefore, the replaceable helmet protective skin 10 also eliminates the desire to replace the helmet for the reasons other than a loss of structural integrity.

As mentioned above, the skin body 12 of the replaceable helmet protective skin 10 is preferably made of a material having the elasticity, waterproof, anti-UV, breathable, and/or insulation functions to enhance the protective function of the skin body 12. Therefore, one or more different materials may be combined to form the replaceable helmet protective skin 10 according to a targeted function or features thereof for variety of different uses of the replaceable helmet protective skin 10. The neoprene material, which has multiple functions of waterproof, elastic, soft, insulated, and breathable at the same time, is perfect for making the replaceable helmet protective skin 10.

The neoprene material is a kind of synthetic rubber and fabric like material, which is designed to act flexibly, durably, and to resist breakdown by water. The elasticity and flexibility features of the neoprene material makes the neoprene perfect for making the replaceable helmet protective skin 10 for fittingly covering the outer surface 42 of the helmet 40. Some of the neoprene with a predetermined thickness also provides the shock-protection feature, so that it is also well suited for being used as padding in external outer surface 42 of the helmet 40. Therefore, the replaceable helmet protective skin 10 not only can protect the helmet 40, but also provide further protection to the head of the wearer by further absorbing the shocking force.

The neoprene material also well known of its unique molecular structure that air and water are insulated therein, so that the replaceable helmet protective skin 10 made of the neoprene material is impervious to water and cold-resistant, so as to further protect the helmet from being damaged via the extreme weather.

Although most waterproof or rubber like materials commonly has the issue of being un-breathable making it a disadvantage, the neoprene made skin body 12 of the replaceable helmet protective skin 10 provides both of the waterproof and breathability functions at the same time, so that the skin body 12 is able to prevent the water impervious through the skin body 12 while being able to dissipate the excessive heat through the breathable neoprene material.

An anti-UV material and/or an insulation layer may be further integrally formed with the skin body 12 for protecting the helmet being structurally damaged by the sun light or heat while the wearer is wearing the helmet in the outdoor space.

A reflective member or reflective material may further provide the skin body 12 at a predetermined position to form a reflective portion 28, in such a manner that the skin body 12 is able to maximize the night visibility while using the helmet 40, so as to enhance the protection of the wearer. For instance, the reflective material may be provided at a bottom peripheral edge of the skin body 12 to form a continuous circular pattern of the reflective portion 28 thereon, so that the reflective portion 28 is able to be seen from multiple angles, so as to enhance the safety of the wearer. It is appreciated that the reflective portion 28 may be located on any other area of the skin body 12 according to variety of needs and designs.

Accordingly, the skin body 12 preferably made of neoprene is reusable, washable, breathable, durable, flexible, and is able to protect the helmet to minimize the damage from the weather or other conditions. The replaceable helmet protective skin 10 may be made of any other materials attachable and detachable while in use, fittingly covering the outer surface 42 of the helmet 40, so as to economically provide a diversity of looks of the helmet 40.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A helmet protective skin for a full-face type helmet having a front facial opening, comprising:

a skin body, which is made of neoprene, configured for detachably and fittingly covering an outer surface of said helmet, wherein said skin body has a receiving cavity for fitting said helmet therein, a peripheral edge arranged for aligning with a peripheral edge of said helmet when said helmet received in said receiving cavity, and an opening formed at a rear portion of said skin body and extended from said peripheral edge thereof to form an edge notch thereat;

two double sided tapes provided along an inner side of a front portion of said skin body for detachably affixing said front portion of said skin body at upper and lower peripheral edges of a finishing rim of said front facial opening in order to align with said upper and lower peripheral edges of said front facial opening of said helmet respectively; and an adjustable fastener provided at said edge notch of said skin body to close said opening at said rear portion of said skin body and to tightly align said peripheral edge of said skin body with a rear finishing rim of said peripheral edge of said helmet, wherein said peripheral edge of said skin body is aligned with said front and rear finishing rims of said helmet where a gap is formed; said peripheral edge of said skin body is received within said gap as if integrally formed at said outer surface of said helmet.

2. The helmet protective skin, as recited in claim 1, wherein said adjustable fastener comprises a first connecting element provided at an outer side of said skin body along a bottom peripheral edge of said skin body and is located at one side edge of said opening, and a second connecting element outwardly extended from an opposed side edge of said opening to form an elongated strap to detachably fasten with said first connecting member so as to close said opening and tightly align said peripheral edge of said skin body with said finishing rim of said peripheral edge of said helmet.

3. The helmet protective skin, as recited in claim 2, wherein said peripheral edge of said skin body is an elastic edge for applying an elastic force along said peripheral edge of said helmet so as to retain said skin body in position.

4. The helmet protective skin, as recited in claim 3, wherein said skin body further has one or more through holes provided at a position when said skin body covers at said outer surface of said helmet, said through holes are aligned with air vents of said helmet for enabling air flow entering into said air vents through said through holes of said skin body.

5. The helmet protective skin, as recited in claim 4, wherein said skin body further has a reflective portion provided at a bottom peripheral edge of said skin body to form a continuous circular pattern for maximizing a night visibility while said helmet is worn.

* * * * *